US011434942B2

(12) United States Patent
Jackan et al.

(10) Patent No.: US 11,434,942 B2
(45) Date of Patent: Sep. 6, 2022

(54) PRESSURE VESSEL ARRANGEMENT PROVIDING PISTON POSITION FEEDBACK, PRESSURE VESSEL, AND METHOD FOR PROVIDING PISTON POSITION FEEDBACK IN A PRESSURE VESSEL

(71) Applicant: Industries Mailhot Inc., Saint-Jacques (CA)

(72) Inventors: Joseph W. Jackan, Eland, WI (US); Sean D. Neitzel, Kronenwetter, WI (US)

(73) Assignee: Industries Mailhot Inc., Saint-Jacques (CA)

( * ) Notice: Subject to any disclaimer, the term of this patent is extended or adjusted under 35 U.S.C. 154(b) by 0 days.

(21) Appl. No.: 16/789,819

(22) Filed: Feb. 13, 2020

(65) Prior Publication Data

US 2020/0400168 A1 Dec. 24, 2020

Related U.S. Application Data

(63) Continuation of application No. 15/668,331, filed on Aug. 3, 2017, now Pat. No. 10,563,678.

(60) Provisional application No. 62/372,648, filed on Aug. 9, 2016.

(51) Int. Cl.
*F15B 15/28* (2006.01)
*F15B 15/14* (2006.01)

(52) U.S. Cl.
CPC ..... *F15B 15/2876* (2013.01); *F15B 15/14* (2013.01); *F15B 2201/515* (2013.01)

(58) Field of Classification Search
CPC ..... F15B 15/2876; F15B 2201/515
See application file for complete search history.

(56) References Cited

U.S. PATENT DOCUMENTS 5,182,980 A 2/1993 Greer
5,856,745 A 1/1999 Morgan et al.
6,234,061 B1 5/2001 Glasson
6,484,620 B2 11/2002 Arshad et al.
(Continued)

*Primary Examiner* — Thomas E Lazo
(74) *Attorney, Agent, or Firm* — Merchant & Gould P.C.

(57) ABSTRACT

A pressure vessel arrangement includes a pressure vessel and an optical sensor arrangement. The pressure vessel includes: a cylinder construction having a cylinder wall extending from a cylinder wall first end to a cylinder wall second end, and having an internal surface forming an interior region; a first end cap closing the cylinder wall first end and having an optical window located therein to permit passage of light therethough and into the interior region; a second end cap closing the cylinder wall second end; and a piston constructed to slide within the cylinder construction interior region along a direction between the cylinder all first end and the cylinder wall second end and along the cylinder construction internal surface to separate the interior region into a first end interior region and a second end interior region. The pressure vessel is constructed to withstand a fatigue test of one million cycles at 5,000 psi without failure. The optical sensor arrangement is located outside of the optical window and includes an emitter for emitting light through the optical window and into the interior region and receiving for receiving light reflected from the piston. Also included is a method for providing a piston position feedback in a pressure vessel.

18 Claims, 13 Drawing Sheets

(56) References Cited

U.S. PATENT DOCUMENTS

| | | | | |
|---|---|---|---|---|
| 6,769,349 | B2 | 8/2004 | Arshad et al. | |
| 6,834,574 | B2 | 12/2004 | Neumann | |
| 7,180,053 | B2 | 2/2007 | Engstrand | |
| 7,716,831 | B2 | 5/2010 | Richard | |
| 8,047,122 | B1 | 11/2011 | Trent | |
| 8,482,607 | B2 | 7/2013 | Webster et al. | |
| 10,240,618 | B2 * | 3/2019 | Beales | F15B 15/2876 |
| 10,563,678 | B2 | 2/2020 | Jackan et al. | |
| 2015/0096440 | A1 | 4/2015 | Subrt | |

* cited by examiner

PRESSURE VESSEL ARRANGEMENT PROVIDING PISTON POSITION FEEDBACK, PRESSURE VESSEL, AND METHOD FOR PROVIDING PISTON POSITION FEEDBACK IN A PRESSURE VESSEL

CROSS-REFERENCE TO RELATED APPLICATIONS

This application is a continuation of U.S. application Ser. No. 15/668,331 filed with the United States Patent and Trademark Office on Aug. 3, 2017, now U.S. Pat. No. 10,563,678. U.S. application Ser. No. 15/668,331 claims the benefit of Provisional Patent Application Ser. No. 62/372,648 filed with the United States Patent and Trademark Office on Aug. 9, 2016. The entire disclosures of U.S. application Ser. Nos. 15/668,331 and 62/372,648 are incorporated herein by reference.

FIELD OF THE DISCLOSURE

The present disclosure relates to a pressure vessel arrangement that provides piston position feedback, a pressure vessel that can be used in a pressure vessel arrangement that provides piston position feedback, and a method of providing piston position feedback in a pressure vessel. In particular, the pressure vessel includes an optical window that allows an optical sensor arrangement located outside of the pressure vessel to detect the position of a piston within the pressure vessel.

BACKGROUND

Pressure vessels having an internal piston are in widespread use to actuate other implements or devices. Sometimes these pressure vessels are referred to as actuators. The applications of such pressure vessels are virtually limitless, and the size and shape of such pressure vessels, as well as the devices actuated by the pressure vessels, are relatively unconstrained. Hydraulic cylinders are one commonly used form of pressure vessel. Hydraulic cylinders are often used as actuators to control the movement of mechanical devices, such as a loader arms, buckets, and claws, on construction equipment. Other forms of pressure vessels include pneumatic cylinders and accumulators.

Accumulators have been used in power fluid systems to store potential energy for later use. While accumulators utilize a piston therein, they often do not include a piston rod extending from the piston to outside of the pressure vessel. Instead, accumulators often include a hydraulic fluid on one side of the piston and a compressible material, such as a gas, on the other side of the piston. Monitoring the position of a piston in an accumulator provides feedback on the stored potential energy available in the accumulator. Not knowing the amount of stored energy remaining in an accumulator represents a safety concern.

In many pressure vessels that utilize a piston that moves within the pressure vessel, there is a need for greater control of the movement of the device imparted by the actuator. Numerous designs are available for detecting the position of a piston rod extending out of a hydraulic cylinder or a pneumatic cylinder in order to detect the location of the piston within the hydraulic cylinder or the pneumatic cylinder. For example, see U.S. Pat. Nos. 8,482,607 and 6,834,574. In the case of an accumulator, where there is no piston rod extending outside of the pressure vessel, such designs would not be useful for determining the location of the piston within the pressure vessel.

Various alternative techniques are provided for sensing the position of a piston within a hydraulic cylinder. Certain alternative techniques provide for placing electronic equipment within the high pressure environment inside a cylinder. Exemplary disclosures include U.S. Pat. Nos. 5,182,980, 5,856,745, 6,234,061, 6,484,620, 6,769,349, 7,716,831, 7,180,053, and U.S. Patent Publication No. 2015/0096440.

Improvements in the design of pressure vessel arrangements and pressure vessels that permit the detection of the location of a piston within a pressure vessel are desired. In particular, designs that do not require monitoring the position of a piston rod or placing electronic equipment inside the high pressure environment inside a pressure vessel are desired.

SUMMARY

A pressure vessel arrangement is provided according to the present disclosure. The pressure vessel arrangement includes a pressure vessel and an optical sensor arrangement. The pressure vessel includes: a cylinder construction having a cylinder wall extending from a cylinder wall first end to a cylinder wall second end, and having an internal surface forming an interior region; a first end cap closing the cylinder wall first end and having an optical window located therein to permit passage of light therethough and into the interior region; a second end cap closing the cylinder wall second end; and a piston constructed to slide within the cylinder construction interior region along a direction between the cylinder all first end and the cylinder wall second end and along the cylinder construction internal surface to separate the interior region into a first end interior region and a second end interior region. The pressure vessel is constructed to withstand a fatigue test of one million cycles at 5,000 psi without failure. The optical sensor arrangement is located outside of the optical window and includes an emitter for emitting light through the optical window and into the interior region and receiving for receiving light reflected from the piston.

A pressure vessel is provided according to the present disclosure. The pressure vessel includes: a cylinder construction having a cylinder wall extending from a cylinder wall first end to a cylinder wall second end, and having an internal surface forming an interior region; a first end cap closing the cylinder wall first end and having an optical window located therein to permit passage of light therethough and into the interior region; a second end cap closing the cylinder wall second end; and a piston constructed to slide within the cylinder construction interior region along a direction between the cylinder all first end and the cylinder wall second end and along the cylinder construction internal surface to separate the interior region into a first end interior region and a second end interior region. The pressure vessel is constructed to withstand a fatigue test of one million cycles at 5,000 psi without failure.

A method for providing piston position feedback in a pressure vessel is provided according to the present disclosure. The method includes steps of: (a) emitting light through an optical window located in an end cap of a pressure vessel, (b) receiving light reflected from the piston; and determining the position of the piston in the cylinder construction based on information about the light emitted and the light received. The pressure vessel includes: a cylinder construction having a cylinder wall extending from a cylinder wall first end to a cylinder wall second end, and having an internal surface forming an interior region; a first end cap closing the cylinder wall first end and having an optical window located therein to permit passage of light therethough and into the interior region; a second end cap closing the cylinder wall second end; and a piston constructed to slide within the cylinder construction interior region along a direction between the cylinder all first end and the cylinder wall second end and along the cylinder construction internal surface to separate the interior region into a first end interior region and a second end interior region. The pressure vessel is constructed to withstand a fatigue test of one million cycles at 5,000 psi without failure.

The presence of an optical quality viewing window in the accumulator allows the user to monitor the location of the piston to determine the amount of stored energy therein and to check the system for leaks that can lead to poor performance or system failure.

DETAILED DESCRIPTION

Figure 1:
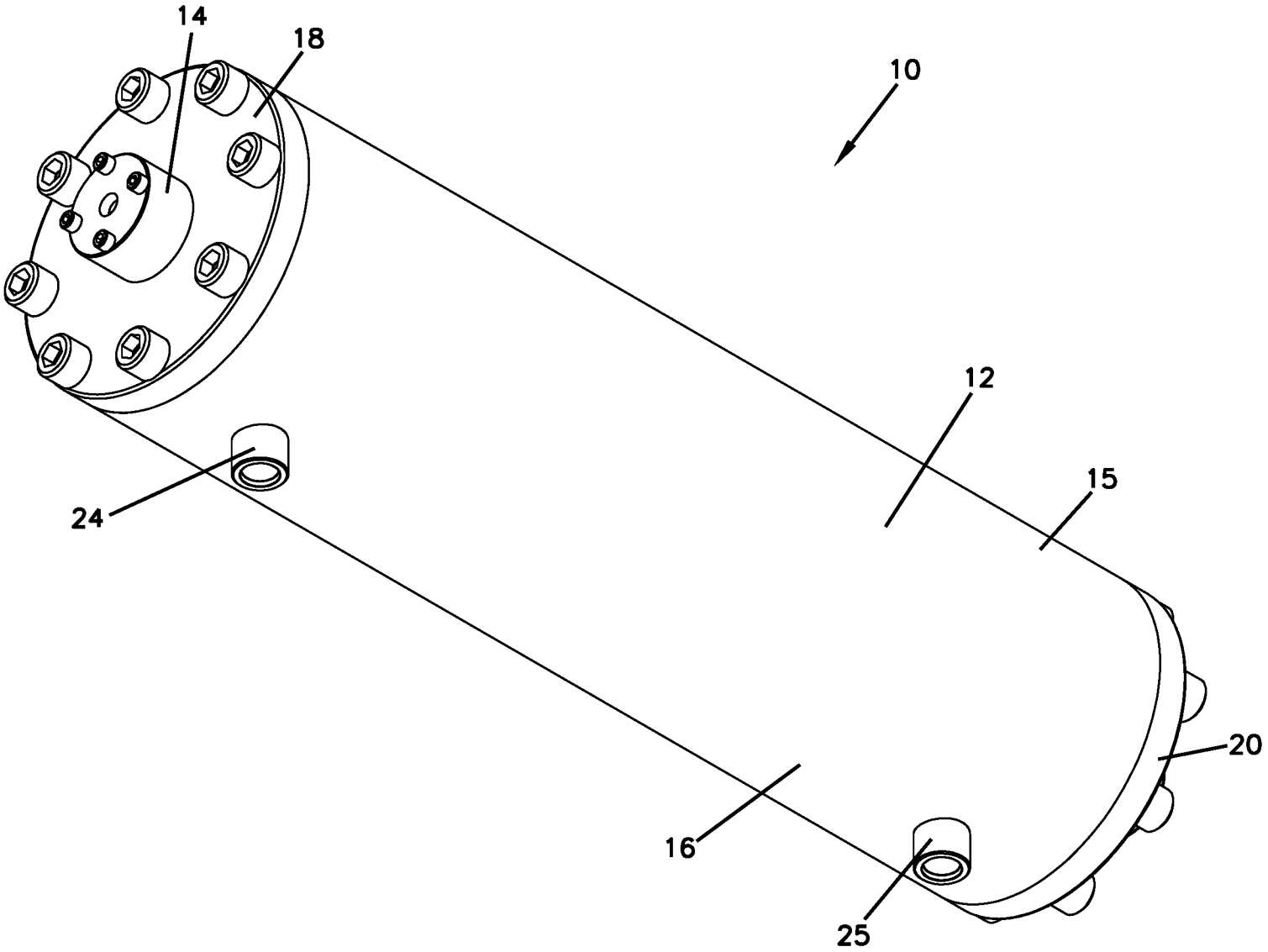
FIG. 1 is a perspective view of a pressure vessel arrangement according to the principles of the present disclosure.
Figure 2:
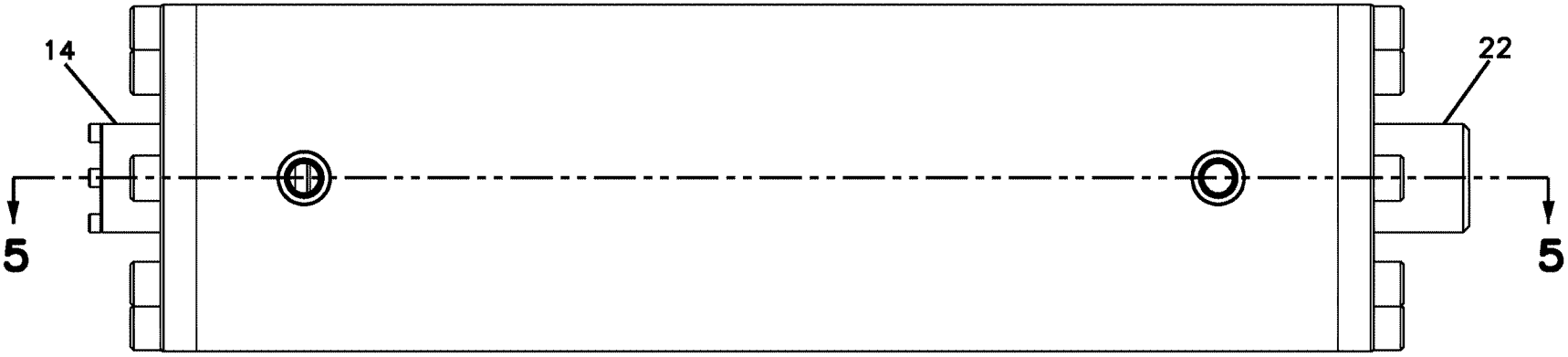
FIG. 2 is a side view of the pressure vessel arrangement according to FIG. 1.
Figure 5:
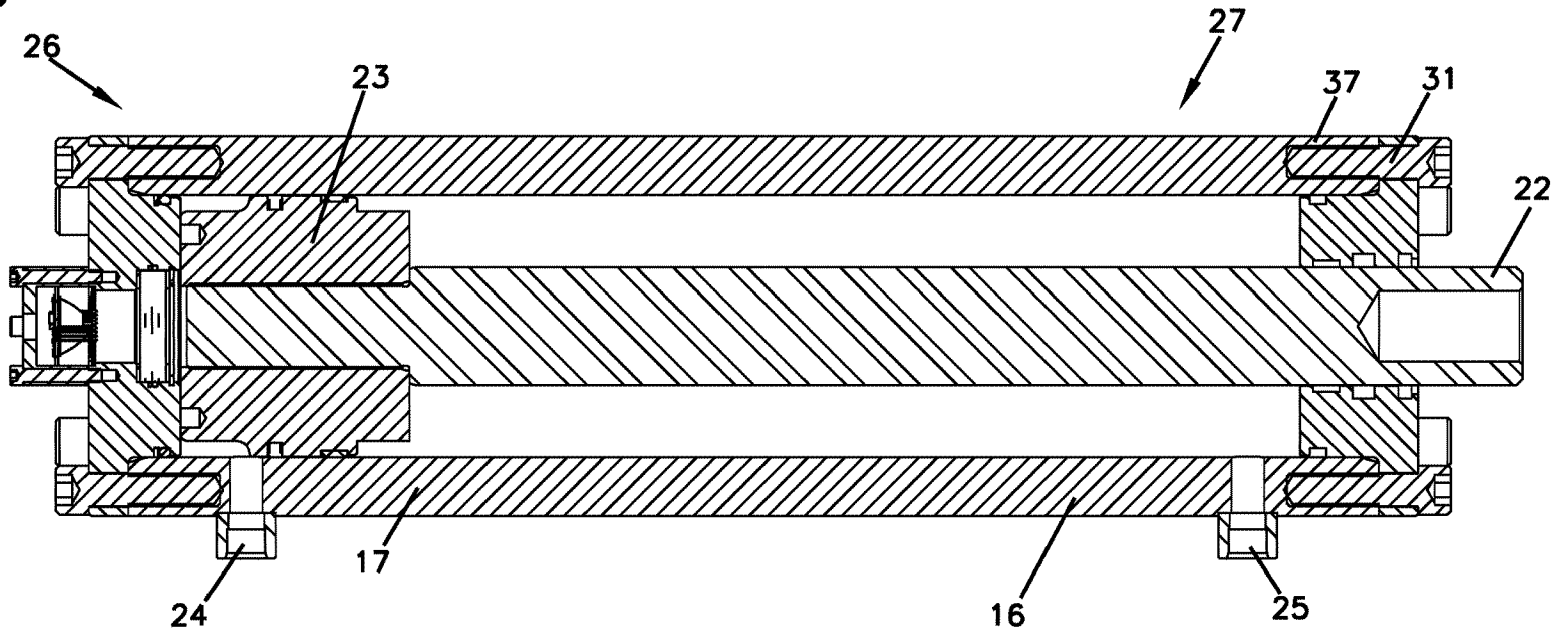
FIG. 5 is a side sectional view of the pressure vessel arrangement according to FIG. 1.
Figure 4:
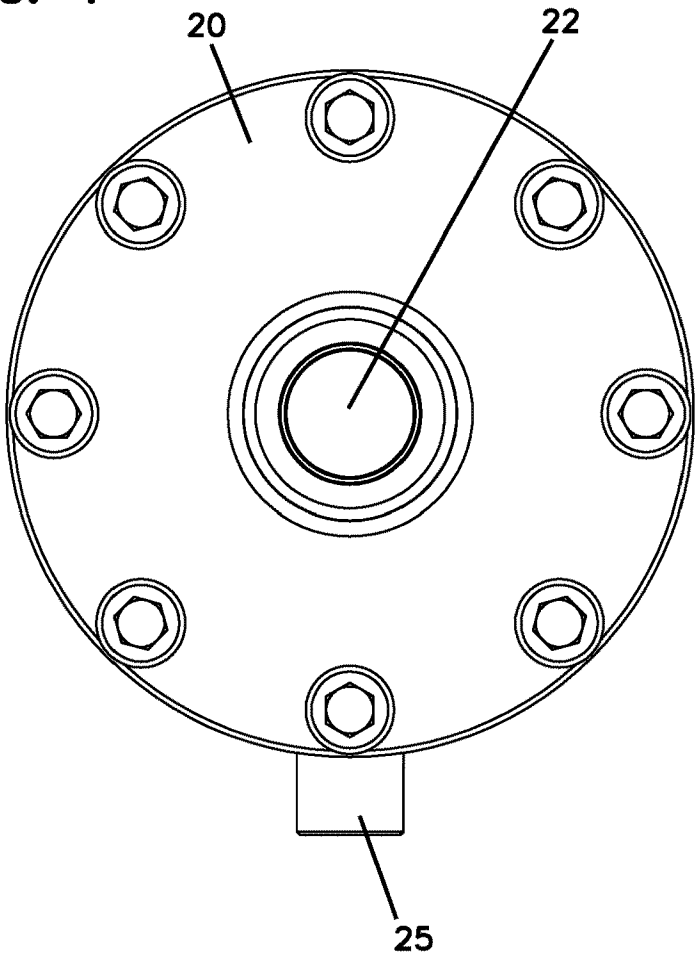
FIG. 4 is an end view of the pressure vessel arrangement according to FIG. 1.
Figure 3:
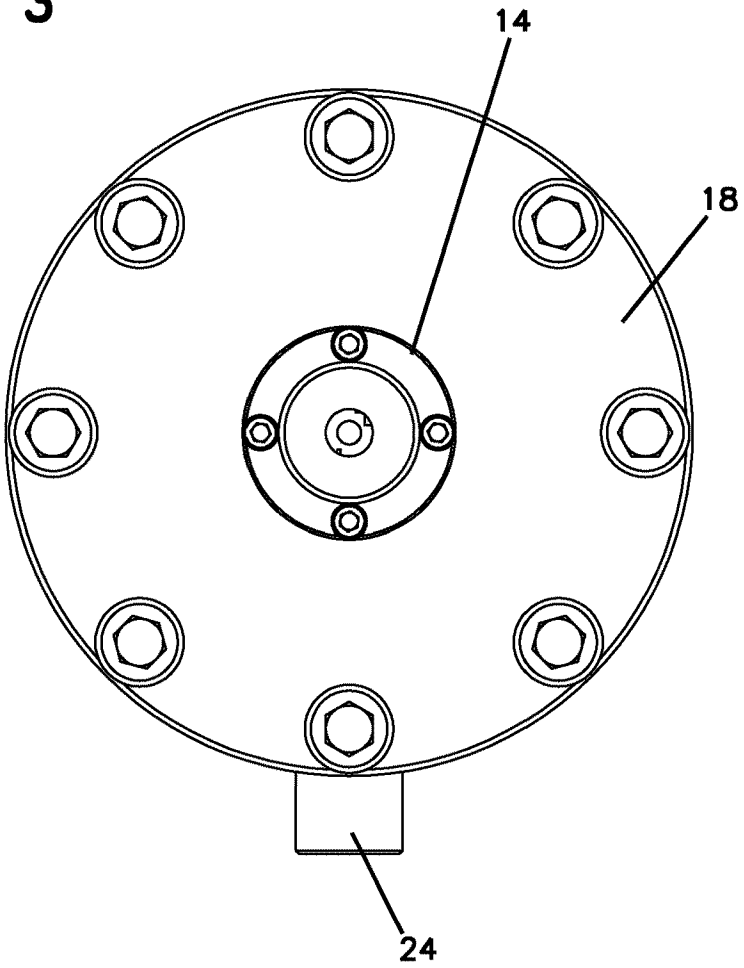
FIG. 3 is an end view of the pressure vessel arrangement according to FIG. 1.

The present disclosure relates to a pressure vessel arrangement that includes a pressure vessel having a piston located therein, and a sensor device that detects the location of the piston within the pressure vessel. The pressure vessel may or may not include a piston rod extending from the piston to outside of the pressure vessel. Exemplary pressure vessels include hydraulic cylinders, pneumatic cylinders, and accumulators. In order to permit the sensor to detect the location of the piston with the pressure vessel, the pressure vessel includes an optical window therein that permits the sensor device to emit light into the interior of the pressure vessel and detect light reflected from the piston.

Now referring to FIGS. 1-5, a pressure vessel arrangement according to the present disclosure is depicted at reference number 10. The pressure vessel arrangement 10 includes a pressure vessel 12 and an optical sensor arrangement 14. The pressure vessel 12 depicted is a hydraulic cylinder 15. The hydraulic cylinder 15 includes a cylinder wall 16, a first end cap 18, a second end cap 20, a piston rod 22, a piston 23 attached to the piston rod 22 and located within the hydraulic cylinder 15 and constructed to slide within the cylinder wall 16, a first hydraulic fluid port 24, and a second hydraulic fluid port 25. The first fluid port 24 can be referred to as the "extend port" and the second fluid port 25 can be referred to as the "retract port." The cylinder wall 16 can be characterized as a cylinder barrel 17. The second end cap 20 is provided with an opening 21 and the rod 22 extending through the opening 21 from inside the pressure vessel 12 to outside the pressure vessel 12. The second end cap 20 can be referred to as the gland or cylinder head. The piston slides within the cylinder barrel 17 and separates the interior region within the hydraulic cylinder 12 into a first end interior region 26 and a second end interior region 27. The piston 23 includes seals there around to prevent fluid from one side of the piston 23 from flowing to the other side of the piston 23.

Figure 6A:
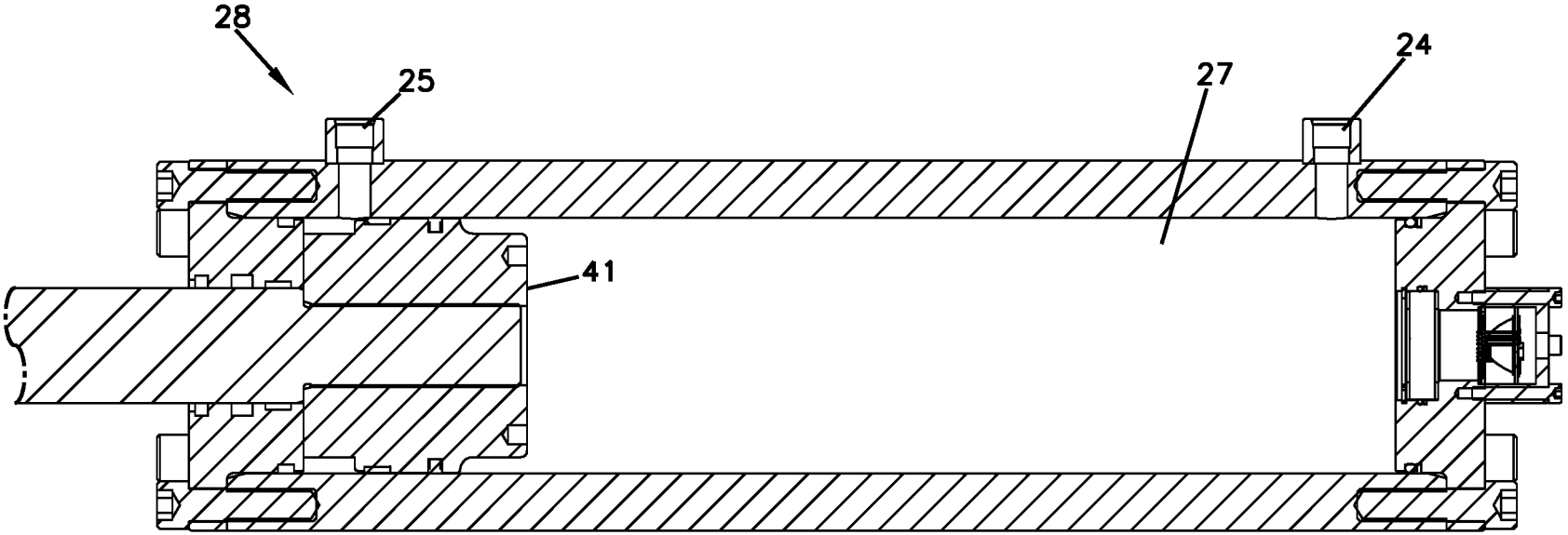
FIGS. 6A and 6B are side sectional views of the pressure vessel arrangement according to FIG. 1 where the piston is shown in extended and retracted positions.
Figure 6B:
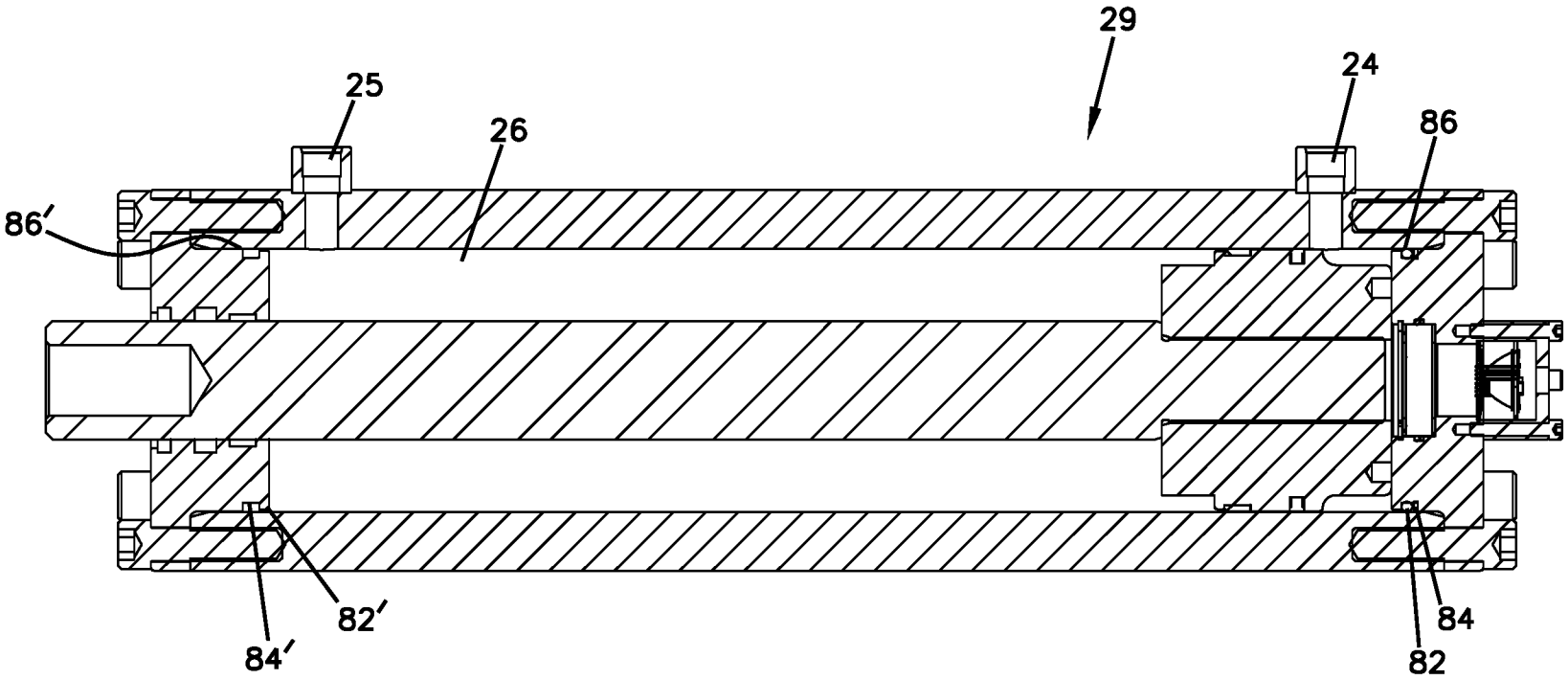

FIGS. 6A and 6B show the pressure vessel arrangement 10 in an extended position 28 and a retracted position 29. When hydraulic fluid is introduced through the extend port 24, the piston moves to the extended position 28 so that the second end interior region is increased in size. When the hydraulic fluid is introduced through the retract port 25, the piston moves to the retracted position 29 so that the first end interior region is increased in size.

Figure 7:
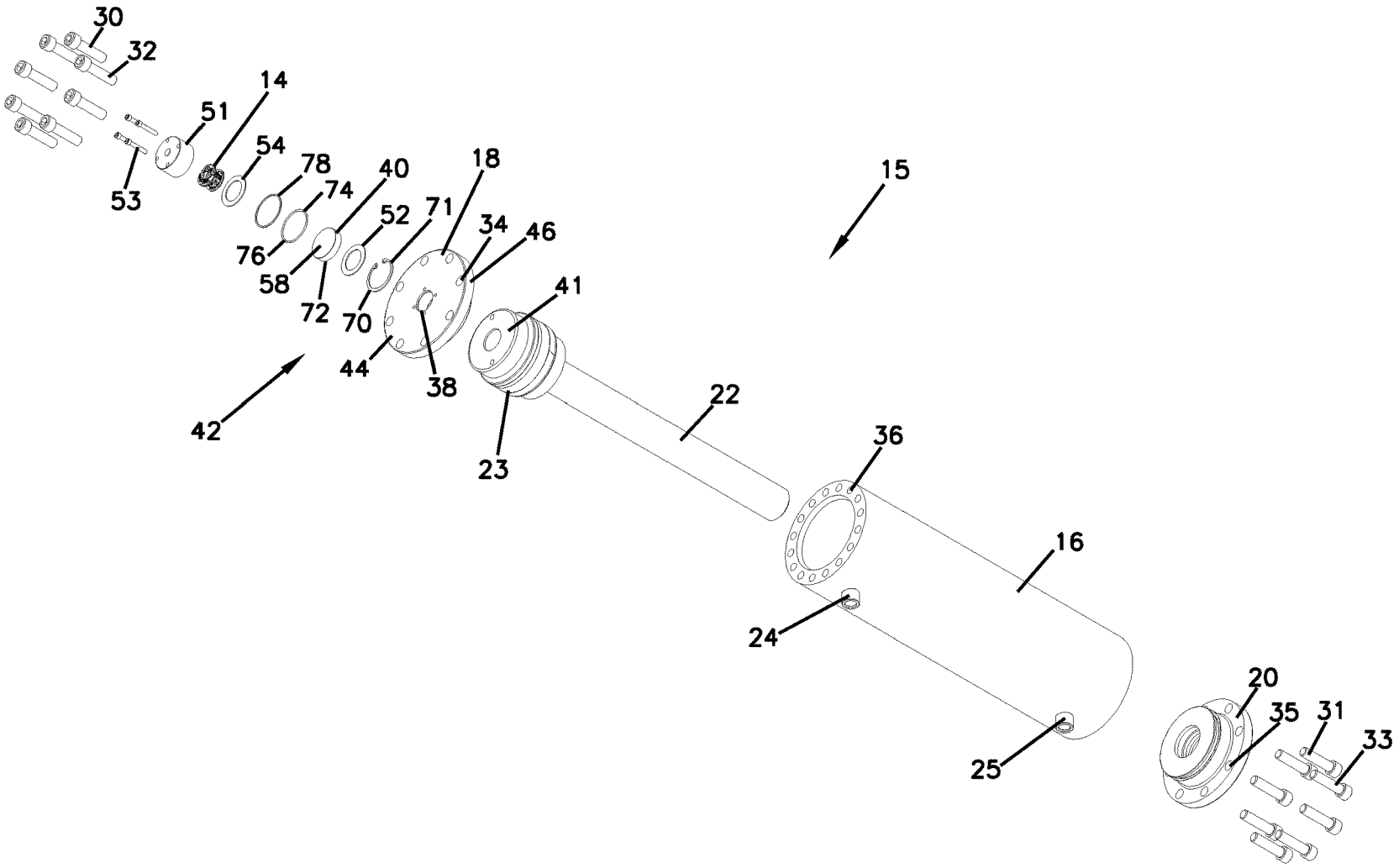
FIG. 7 is an exploded perspective view of the pressure vessel arrangement of FIG. 1.

Now referring to FIG. 7, the hydraulic cylinder 15 is shown in an exploded view where the first end cap 18 is attached to the cylinder wall 16 by a plurality of fasteners 30. The plurality of fasteners 30 are illustrated as bolts 32. The fasteners 30 are received through the end cap openings 34 and the cylinder wall openings 36. The second end cap 20 is attached to the cylinder wall 16 by a plurality of fasteners 31. The plurality of fasteners 31 are illustrated as bolts 33. The fasteners 31 are received through the end cap openings 35 and the cylinder wall openings 37 (see FIG. 5). The end caps 18 and 20 are attached to the cylinder wall 16 to provide a seal to resist leakage of fluid.

The first end cap 18 includes a sensor opening 38 constructed to receive the optical sensor arrangement 14 and that permits observation of the position of the piston 23 within the hydraulic cylinder 15. The sensor opening 38 is closed by the presence of an optical window 40.

Figure 8:
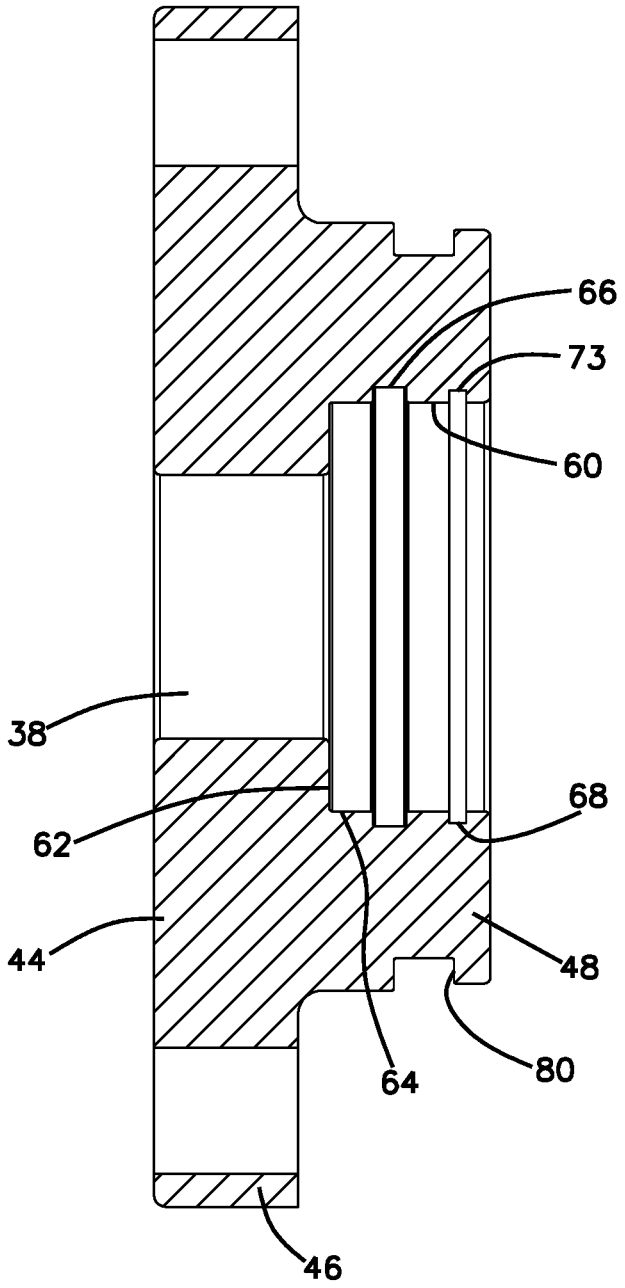
FIG. 8 is a sectional view of the first end cap part of the pressure vessel arrangement of FIG. 1.
Figure 9:
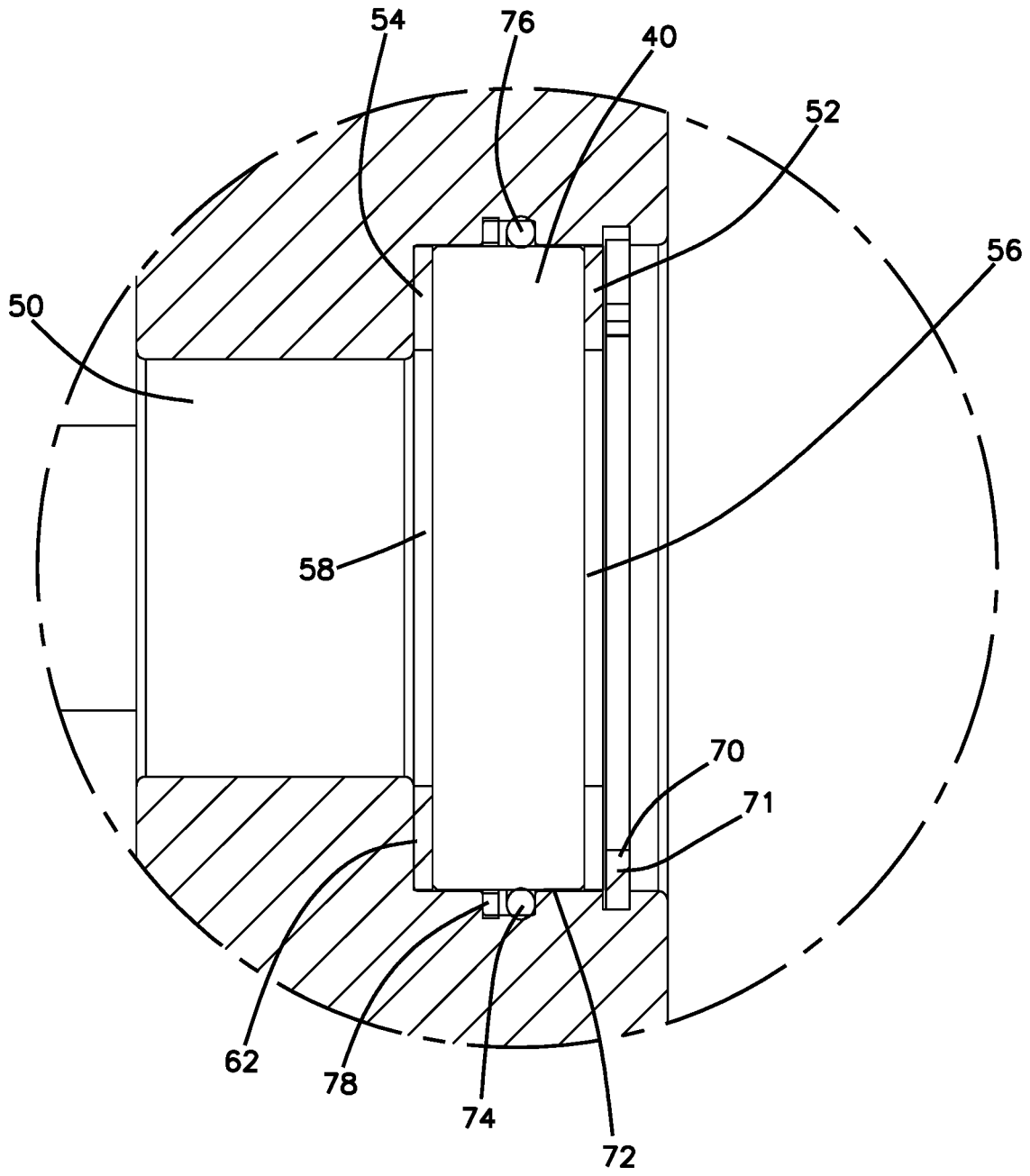
FIG. 9 is a sectional view of the first end cap of FIG. 8 but shown with the optical window 40 and the optical window attachment construction 42.
Figure 10:
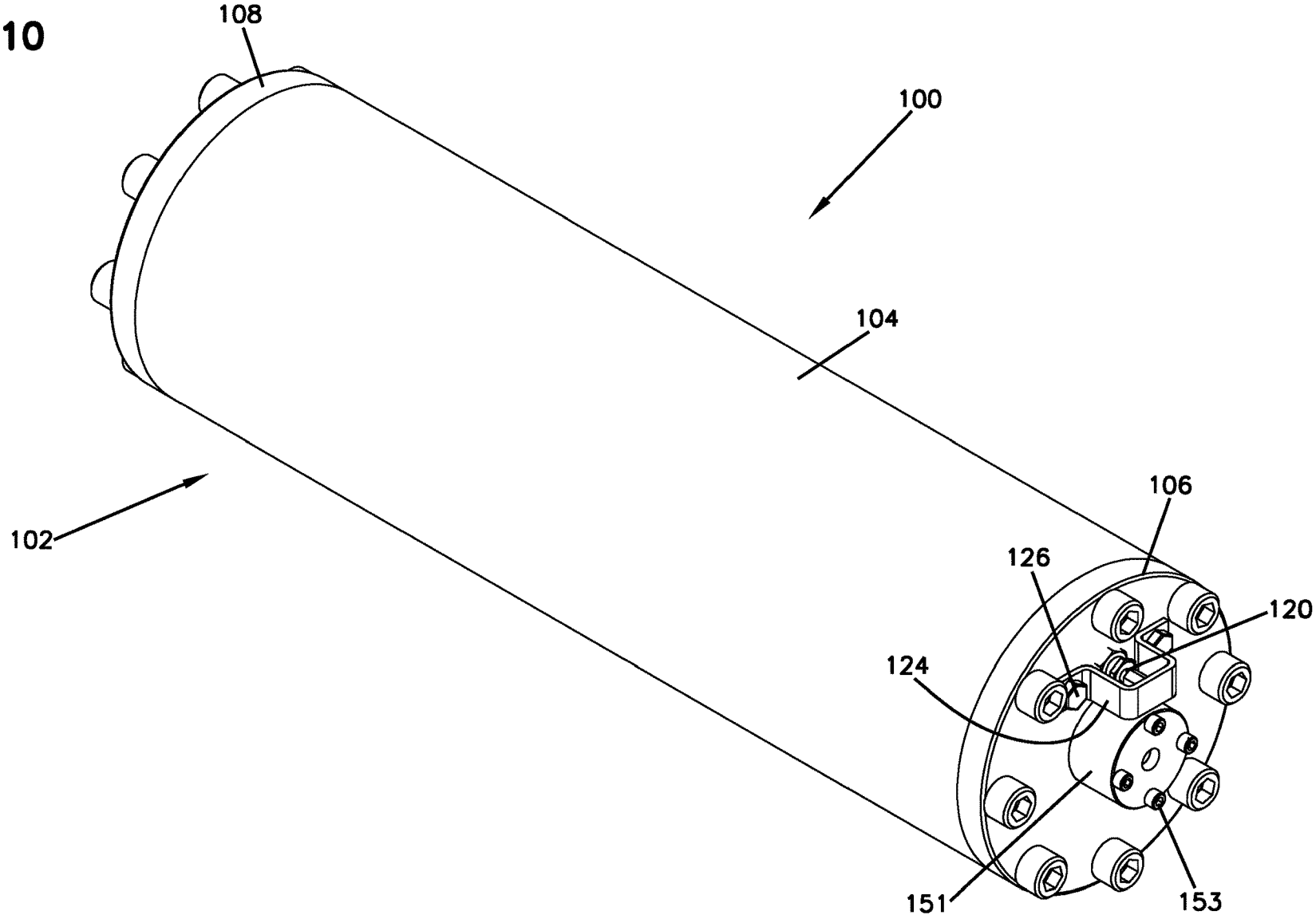
FIG. 10 is a perspective view of a pressure vessel arrangement in the form of an accumulator according to the principles of the present disclosure.
Figure 11:
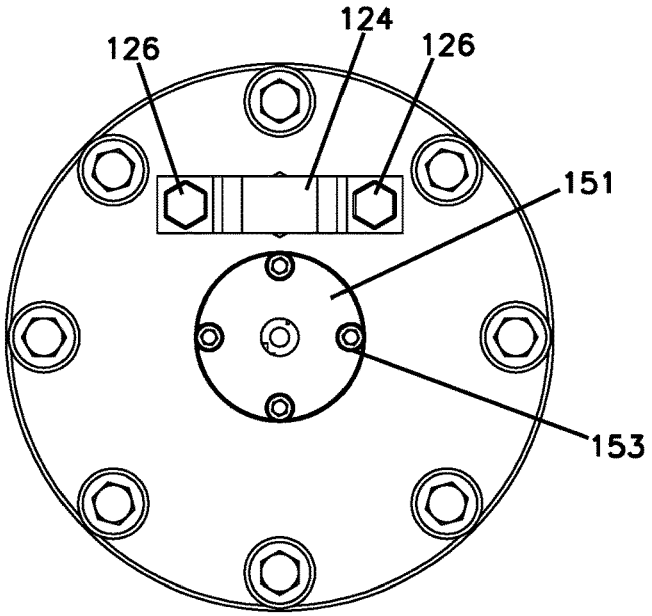
FIG. 11 is an end view of the pressure vessel arrangement according to FIG. 10.
Figure 13:
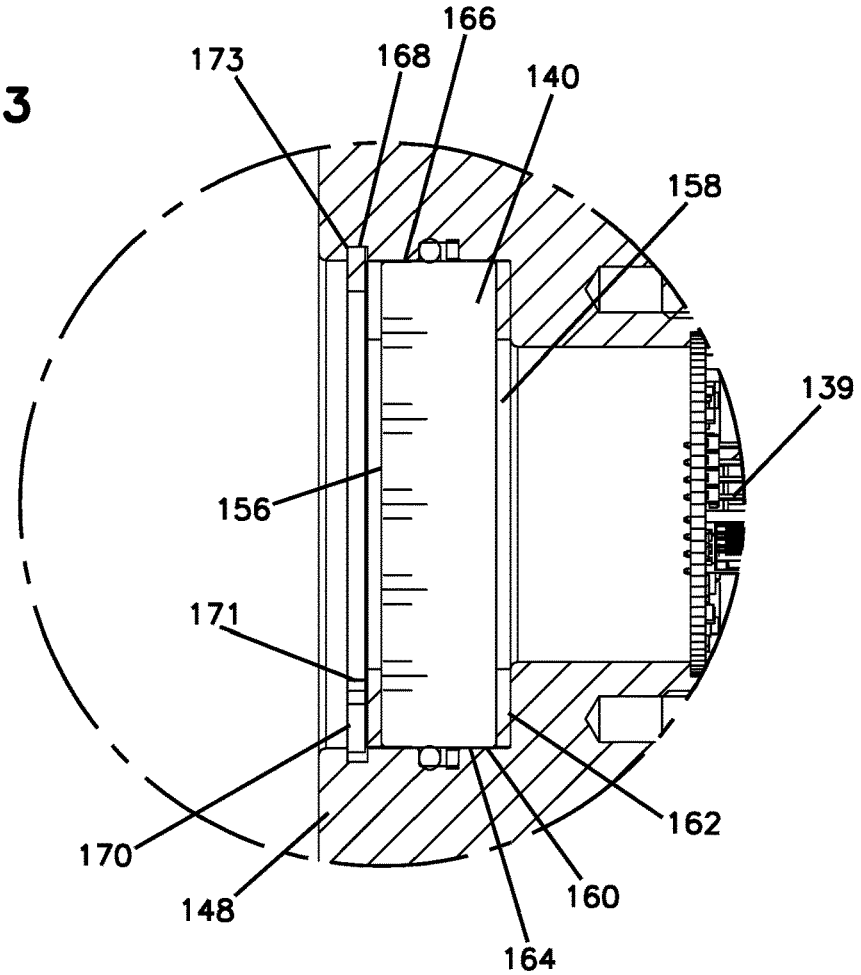
FIG. 13 is a detail view of a portion of the sectional view of FIG. 12.
Figure 12:
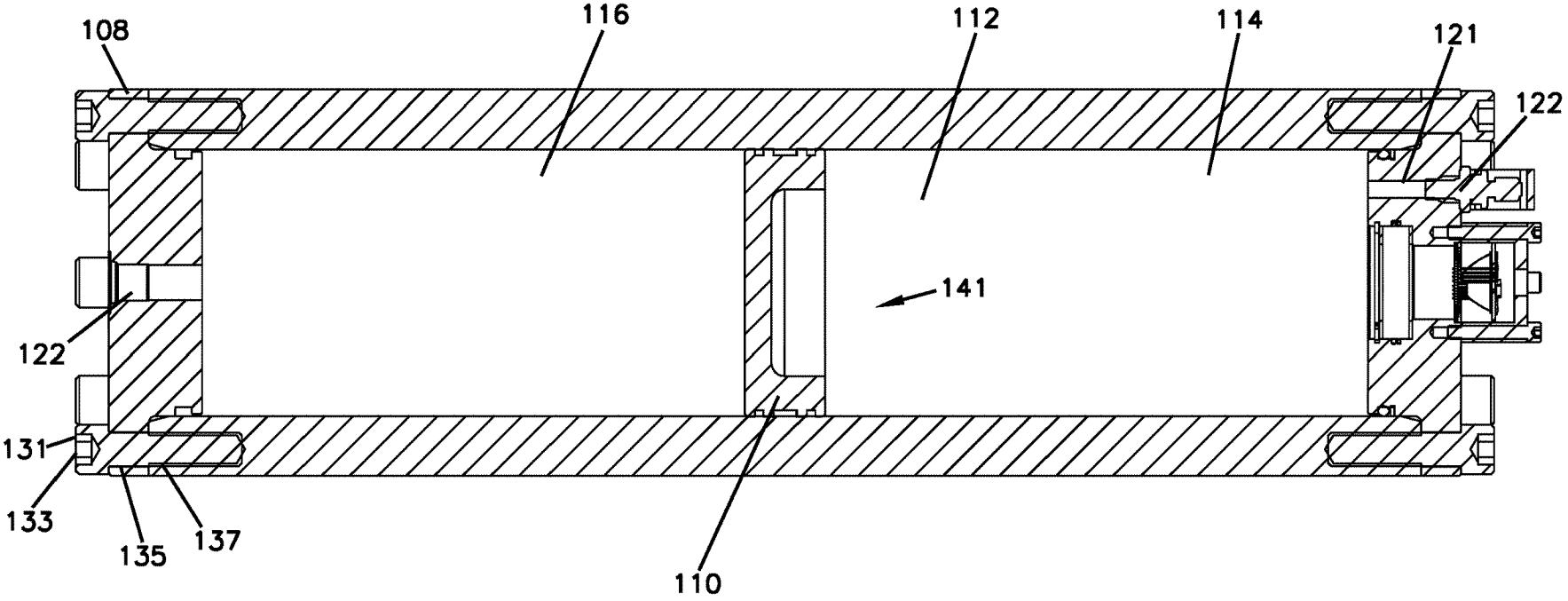
FIG. 12 is sectional view of the pressure vessel arrangement taken along lines A-A of FIG. 11.
Figure 14:
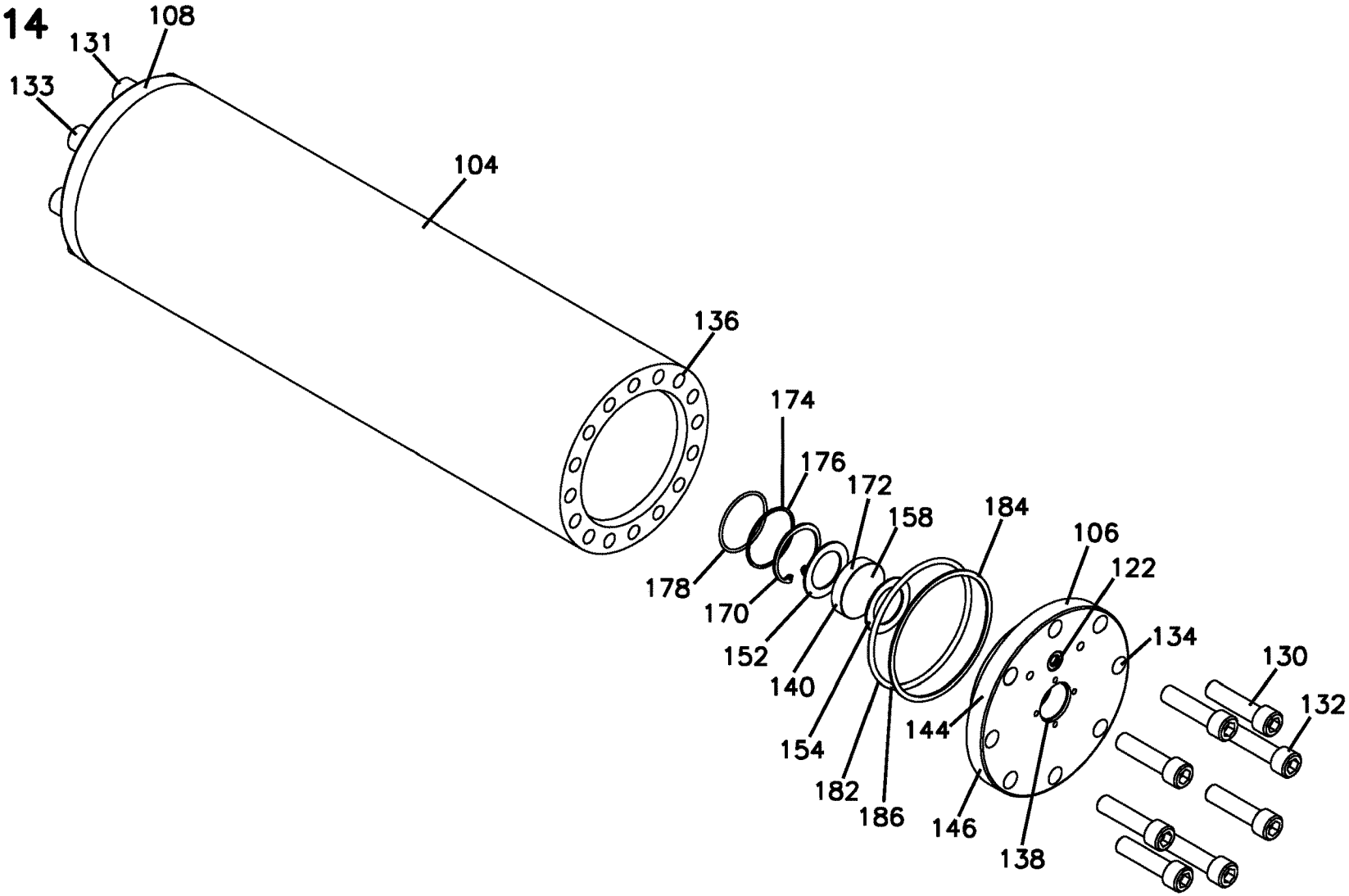
FIG. 14 is an exploded view of the pressure vessel arrangement of FIG. 10.

In reference to FIGS. 7-9, the optical window 40 is provided in the first end cap 18 in order to permit the optical sensor arrangement 14, located outside of the hydraulic cylinder 15, to detect the location of the piston within the hydraulic cylinder 15. The first end cap 16 includes the optical window 40 and an optical window attachment construction 42 for holding the optical window 40 in place as part of the first end cap 16. The first end cap 18 includes a cap structure 44 that is provided as a metallic material capable of withstanding the pressure achieved within the hydraulic cylinder 15, and remain attached to the cylinder wall 16 by the plurality of fasteners 30. The cap structure 44 includes a rim region 46 and an optical window retaining region 48. The rim region 46 includes the plurality of openings 34 through which the plurality of fasteners 30 extend. The optical window retaining region 48 includes recesses and projections to help retain the optical window 40 therein. An optical opening or cavity 50 extends through the cap structure 44 and is closed by the optical window 40. On the outside of the hydraulic cylinder 15 is provided the sensor opening 38 wherein the optical sensor arrangement 14 can be located. In the embodiment shown, the optical sensor arrangement 14 is located within the sensor opening and held in place by the optical sensor retainer 51 which can be held to the first end cap 18 by the fastener 53. It should be understood that the hydraulic cylinder 15 can be provided without the sensor opening 38 for locating the optical sensor arrangements or with a smaller sensor opening. In general, the sensor opening can be provided to help protect the optical sensor arrangement but need not be provided since the optical sensor arrangement can be sufficiently protected by the optical sensor retainer 51.

The cap structure 44 should be sufficient to withstand the pressures within the hydraulic cylinder 15, and the depth of the sensor opening 38 can be sufficient to accommodate the structural integrity of the hydraulic cylinder 15. The optical sensor arrangement 14 can be located either in the sensor opening 38 or outside of the sensor opening 38. In any event, light emitted from the optical sensor arrangement 14 would pass through the optical window 40, and light reflected from the piston surface would pass through the optical window 40 and be received by the optical sensor arrangement 14. As a result, the location of the piston 23 within the cylinder barrel 17 can be determined. The piston 23 includes a facing surface 41 which reflects the light from the optical sensor arrangement 14.

The optical window 40 is provided having a structure sufficient to withstand the pressures within the hydraulic cylinder 12 and also permit light to pass therethrough. In addition, the optical window 40 should remain separate from the metallic material of the cap structure 44. The changes in pressure within the hydraulic cylinder 15 can cause vibration and/or impact on the optical window 40. If the optical window 40 is permitted to contact the metallic material of the cap structure 44, there is a possibility that the pressure fluctuations within the hydraulic cylinder 12 may cause impacts between the optical window 40 and the cap structure 44 thereby resulting in cracking of the optical window 40. In order to reduce or eliminate contact between the optical window 40 and the metallic material of the cap structure 44, an inside gasket 52 and an outside gasket 54 are arranged on the optical window inside surface 56 and the optical window outside surface 58, respectively. The cap structure 44 includes an optical window receiving region 60 that receives the optical window 40, the inside gasket 52, and the outside gasket 54. The optical window receiving region 60 includes an optical window receiving region end surface 62 and an optical window receiving region peripheral surface 64. The outside gasket 54 fits between the optical window receiving region end surface 62 and the optical window outside surface 58 to provide separation between the optical window outside surface 58 and the optical window receiving region end surface 62. The inside gasket 56 fits between the optical window inside surface 56 and the optical window retainer 70. The optical window retainer 70 is shown as a snap ring 71. As illustrated, the inside gasket 52 and the outside gasket 54 are provided with open interiors to permit light to pass therethrough.

The optical window receiving region peripheral surface 64 includes a seal engagement region 66 and a retainer engagement region 68. The retainer 70 engages the retainer engagement region 68 to hold the optical window 40 within the optical window retaining region 48. For the embodiment shown, the retainer 70 is a snap ring 71 that engages a groove 73 in the engagement region 68 that prevents the optical window 40 secured within the optical window receiving region 60. The inside gasket 52 fits between the retainer 70 and the optical window inside surface 56 and helps prevent the optical window inside surface 56 from contacting the retainer 70. The optical window 40 includes a peripheral surface 72, and a seal member 74 can be provided extending around the optical window peripheral surface 72 and thereby prevent the optical window 40 from touching the cap structure 44 along the optical window peripheral surface 72. The seal member 74 can be provided as an optical window O-ring 76. In addition, a backup gasket 78 can be provided to help hold the seal member 74 in place and prevent pinching when installing the optical window 40 and the seal member 74.

As more clearly shown in FIGS. 6B and 8, in order to provide a seal between the first end cap 18 and the cylinder wall 16, the cap structure 44 can include a cylinder wall seal member recess 80 constructed to receive the end cap/cylinder walls seal member 82 and, optionally, the backup gasket 84. The seal member 82 can be provided as a cap O-ring 86. A similar structure can be used to provide a seal between the second end cap 20 and the cylinder wall 16 where a cylindrical wall seal member recess 80' is provided for receiving the seal member 82' (preferably the cap O-ring 86') and, optionally, the backup gasket 84'.

The optical window 40, when mounted to the cap structure 44 via the optical window attachment construction 42, provides a pressure vessel that satisfies a 5,000 psi internal working pressure test wherein the pressure vessel is subjected to fatigue testing of one million cycles at 5,000 psi. Passing the test means no failure after one million cycles at 5,000 psi. That means that the pressure vessel is cycled one million times to an internal pressure of 5,000 psi. The test can be referred to as a fatigue test, and satisfying the test means that the optical window does not crack, and that no fluid or gas between the piston and the optical window escapes via the optical window or around the optical window during the test. Preferably, the pressure vessel satisfies a 20,000 psi burst test where the internal pressure is tested at 20,000 psi and the pressure vessel does not leak.

An advantage of the presence of the optical window 40 is that it is possible to better observe whether there is failure between the piston and the cylinder barrel. At times, the seal around the piston separating the first internal compartment from the second internal compartment fails. The failure may result after an extended number of piston cycles. Failure of the seal between the piston and the cylinder barrel are results in hydraulic fluid or gas bypassing the seal. By having the optical window 40 in the first end cap 18, it is possible to detect whether fluid from the second internal compartment begins mixing with fluid present in the first internal compartment located between the optical window 40 and the piston. While it might be possible to observe the mixing by the naked eye, it is expected that the optical sensor arrangement 14 can be constructed to detect a difference in the media located in the first interior region. In addition, by providing the sensor arrangement 14 outside of the pressure vessel 12, the sensor arrangement 14 is not subjected to the pressures inside of the pressure vessel 12 and there is no need to create a seal between the sensor arrangement 14 and the pressure vessel 12.

Within the pressure vessel, various media can be used. Exemplary media hydraulic fluid at nitrogen. Additional exemplary media include atmospheric gas, water, sea water, and various types of hydraulic fluids including mineral based hydraulic fluids, and synthetic based hydraulic fluids.

The glass material of the optical window can be selected as a glass material capable of withstanding the stresses and pressures inside a pressure vessel. An exemplary glass material that can be used as the optical window 40 is sapphire glass available from Meller Optics, Inc. The sapphire glass can be machined with precision quality to limit imperfections that may cause stress concentrations and failures. Applicable polishing of 16 Ra (micro-inches) can be applied to the outside diameter to ensure proper sealing. Exemplary sapphire glass specifications are identified as follows: diameter of 2.122 inches, thickness of 0.50 inch, optical grade C-plane sapphire (free from inclusion), 0.015 inch maximum bevels on both sides, parallelism of less than 3 arc minutes, a flatness of 10 waves maximum at 633 nm on both faces, a surface quality of 60-40 per mil-prf-13830 on both faces, a clear aperture of 85%, and polished using 16 Ra (micro-inches) surface roughness.

The inside and outside gaskets can be formed from Ultra-wear-resistant PTFE-filled Delrin acetal resin. The O-rings can be repaired from Nitrile (Buna-N) NBR 70 shore A and NBR 90 shore A.

An optical sensor that can be used in the optical sensor arrangement includes an optical sensor available from Motion Controls, LLC of Hartford, Wis. It is also noted that the optical sensor can be in communication with a computer or processor that manipulates the data to determine the location of the piston within the pressure vessel and then send the information to the appropriate controls and/or monitoring equipment.

The pressure vessel 10 can be characterized as a hydraulic cylinder when hydraulic fluid in provided therein or as a pneumatic cylinder when air or gas is provided therein. The reference to pressure vessel can include both pressure vessels using hydraulic fluid and gas therein.

Now referring to FIGS. 10-14, a pressure vessel arrangement is shown at reference number 100. The pressure vessel arrangement is similar to the pressure vessel arrangement 10 except that it can be characterized as an accumulator 102. The accumulator 102 includes a cylinder wall 104, a first end cap 106, a second end cap 108, and a piston 110 that moves within the cylinder wall 104 and divides the pressure vessel arrangement interior 112 into a first end interior region 114 and a second end interior region 116. The accumulator 102 need not include a piston rod extending from the piston 110 and through the second end cap 108 which is typically seen in hydraulic and pneumatic cylinders. It should be understood that the accumulator 102 can include a piston rod extending from the piston 110 and through the second end cap 108, if desired. For the accumulator shown, the first end interior region 114 includes a compressible media (typically a gas such as nitrogen or air) and the second end interior region 116 includes a non-compressible media (typically a hydraulic fluid such as oil). The compressible media can be charged into the first end interior region via the charge valve 120 and the non-compressible media can flow into and out from the second end interior region 116 via the hydraulic fluid port 122. Accordingly, as energy is applied to the accumulator 102 by introducing non-compressible media into the second end interior region 116, the compressible media in the first end interior region 114 can be compressed and, as a result, store energy therein. The stored energy can later be released by allowing the compressible media to expand. The piston serves to keep the first end interior region 114 separate from the second end interior region 116. In this manner, the accumulator can be used to store potential energy and later release the potential energy. Exemplary application for accumulators include regenerative braking for vehicles and other types of energy storage devices that can be used in situations where kinetic energy is converted to potential energy and stored for later release. Applications for such accumulators may be found in harnessing energy from, for example, hydro power such as dams and water falls.

In the accumulator 102, the first end interior region 114 is charged with compressible media via the charge valve 120 and the charge media port 121. An exemplary compressible media is nitrogen gas. In general, once the media is charged into the first end interior region 114, it stays there during multiple cycles of use of the accumulator 102. The charge valve 120 can be protected by the charge valve bracket 124 that can be attached to the first end 106 via fasteners 126. When hydraulic fluid is introduced through the hydraulic fluid port 122, the piston 110 moves to increase the second end interior region 116, and the first end interior region 114 is decreased in size as a result of compression of the compressible media therein. When hydraulic fluid leaves through the hydraulic fluid port 122, the piston 110 move to decrease the size of the second end interior region 116, and the size of the first end interior region 114 is increased as a result of the expansion of the compressible media.

The first end cap 106 is attached to the cylinder wall 104 by a plurality of fasteners 130. The plurality of fasteners 130 are illustrated as bolts 132. The fasteners 130 are received through the end cap openings 134 and the cylinder wall openings 136. The second end cap 108 is attached to the cylinder wall 104 by a plurality of fasteners 131. The plurality of fasteners 131 are illustrated as bolts 133. The fasteners 131 are received through the end cap openings 135 and the cylinder wall openings 137. The end caps 106 and 108 are attached to the cylinder wall 104 to provide a seal to resist leakage of fluid.

The first end cap 106 includes a sensor opening 138 constructed to receive the optical sensor arrangement 139 and that permits observation of the position of the piston 110 within the accumulator 102. The sensor opening 138 is closed by the presence of an optical window 140.

The optical window 140 is provided in the first end cap 106 to permit the optical sensor arrangement 139, located outside of the accumulator 102, to detect the location of the piston 110 within the accumulator 102. The structure of the accumulator 102 for containing the optical window 140 therein can be the same as for the hydraulic cylinder 15 described previously. In general, the accumulator 102 includes the optical window 140 and an optical window attachment construction 142 for holding the optical window 140 in place as part of the first end cap 106. The first end cap 106 includes a cap structure 144 that is provided as a metallic material capable of withstanding the pressure achieved within the accumulator 102, and remain attached to the cylinder wall 104 by the plurality of fasteners 130. The cap structure 144 includes a rim region 146 and an optical window retaining region 148. The rim region 146 includes the plurality of openings 134 through which the plurality of fasteners 130 extend. The optical window retaining region 148 includes recesses and projections to help retain the optical window 140 therein. An optical opening or cavity 150 extends through the cap structure 144 and is closed by the optical window 140. On the outside of the accumulator 102 is provided the sensor opening 138 wherein the optical sensor arrangement 139 can be located. In the embodiment shown, the optical sensor arrangement 139 is located within the sensor opening and held in place by the optical sensor retainer 151 which can be held to the first end cap 106 by the fastener 153. It should be understood that the accumulator 102 can be provided without the sensor opening 138 for locating the optical sensor arrangements or with a smaller sensor opening. In general, the sensor opening can be provided to help protect the optical sensor arrangement but need not be provided since the optical sensor arrangement can be sufficiently protected by the optical sensor retainer 151.

The cap structure 144 should be sufficient to withstand the pressures within the accumulator 102, and the depth of the sensor opening 138 can be sufficient to accommodate the structural integrity of the accumulator 102. The optical sensor arrangement 139 can be located either in the sensor opening 138 or outside of the sensor opening 138. In any event, light emitted from the optical sensor arrangement 139 would pass through the optical window 140, and light reflected from the piston surface would pass through the optical window 140 and be received by the optical sensor arrangement 139. As a result, the location of the piston 110 within the accumulator 102 can be determined. The piston 110 includes a facing surface 141 which reflects the light from the optical sensor arrangement 139.

The optical window 140 is provided having a structure sufficient to withstand the pressures within the accumulator 102 and also permit light to pass therethrough. In addition, the optical window 140 should remain separate from the metallic material of the cap structure 144. The changes in pressure within the accumulator 102 can cause vibration and/or impact on the optical window 140. If the optical window 140 is permitted to contact the metallic material of the cap structure 144, there is a possibility that the pressure fluctuations within the accumulator 102 may cause impacts between the optical window 140 and the cap structure 144 thereby resulting in cracking of the optical window 140. In order to reduce or eliminate contact between the optical window 140 and the metallic material of the cap structure 144, an inside gasket 152 and an outside gasket 154 are arranged on the optical window inside surface 156 and the optical window outside surface 158, respectively. The cap structure 144 includes an optical window receiving region 160 that receives the optical window 140, the inside gasket 152, and the outside gasket 154. The optical window receiving region 160 includes an optical window receiving region end surface 162 and an optical window receiving region peripheral surface 164. The outside gasket 154 fits between the optical window receiving region end surface 162 and the optical window outside surface 158 to provide separation between the optical window outside surface 58 and the optical window receiving region end surface 62. The inside gasket 156 fits between the optical window inside surface 156 and the optical window retainer 170. The optical window retainer 170 is shown as a snap ring 171. As illustrated, the inside gasket 152 and the outside gasket 154 are provided with open interiors to permit light to pass therethrough.

The optical window receiving region peripheral surface 164 includes a seal engagement region 166 and a retainer engagement region 168. The retainer 170 engages the retainer engagement region 168 to hold the optical window 140 within the optical window retaining region 148. For the embodiment shown, the retainer 170 is a snap ring 171 that engages a groove 173 in the engagement region 168 that keeps the optical window 140 secured within the optical window receiving region 160. The inside gasket 152 fits between the retainer 170 and the optical window inside surface 156 and helps prevent the optical window inside surface 156 from contacting the retainer 170. The optical window 140 includes a peripheral surface 172, and a seal member 174 can be provided extending around the optical window peripheral surface 172 and thereby prevent the optical window 140 from touching the cap structure 144 along the optical window peripheral surface 172. The seal member 174 can be provided as an optical window O-ring 176. In addition, a backup gasket 178 can be provided to help hold the seal member 174 in place and prevent pinching when installing the optical window 140 and the seal member 174.

In order to provide a seal between the first end cap 106 and the cylinder wall 104, the cap structure 144 can include a cylinder wall seal member recess constructed to receive the end cap/cylinder walls seal member 182 and, optionally, the backup gasket 184. The seal member 182 can be provided as a cap O-ring 186. A similar structure can be used to provide a seal between the second end cap 108 and the cylinder wall 104.

The optical window 140, when mounted to the cap structure 144 via the optical window attachment construction 42, provides a pressure vessel that satisfies a 5,000 psi internal working pressure test wherein the pressure vessel is subjected to fatigue testing of one million cycles at 5,000 psi. Passing the test means no failure after one million cycles at 5,000 psi. That means that the pressure vessel is cycled one million times to an internal pressure of 5,000 psi. The test can be referred to as a fatigue test, and satisfying the test means that the optical window does not crack, and that no fluid or gas between the piston and the optical window escapes via the optical window or around the optical window during the test. Preferably, the pressure vessel satisfies a burst test at 20,000 psi wherein the pressure vessel is subjected to a pressure of 20,000 psi to make sure that the pressure vessel can withstand the pressure.

Figure 15:
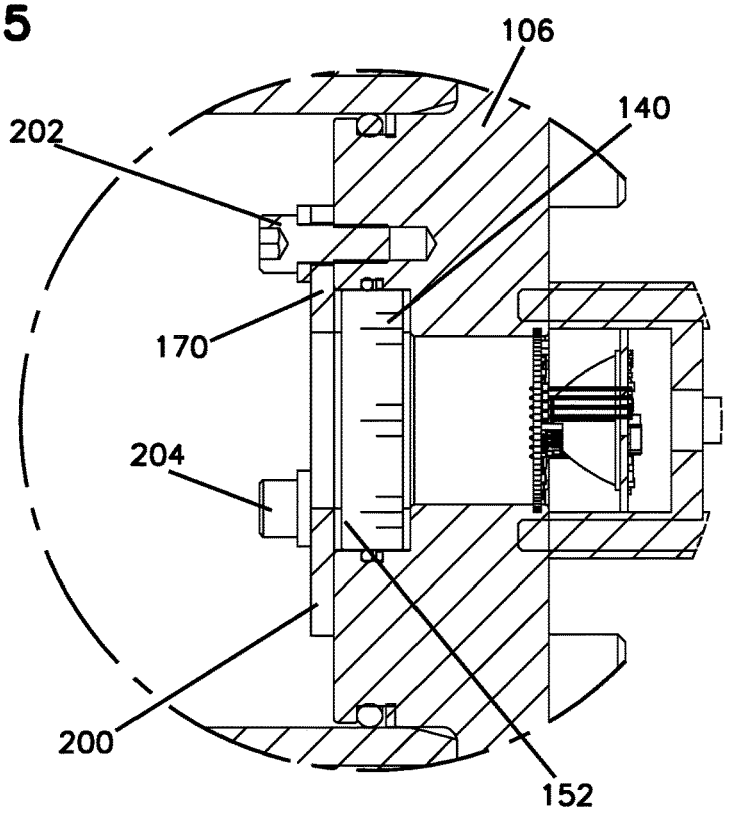
FIG. 15 is a detail view of a portion of a pressure vessel arrangement showing an alternative technique for retaining the optical window.

Now referring to FIG. 15, an alternative arrangement is provided for attaching the optical window 140 to the first end cap 106. The retainer 170 is provided as bracket 200 that is held to the first end cap 106 by a plurality of fasters 202 that are provided as bolts 204. The inside gasket 152 is held between the window inside surface 156 and the bracket 200.

Figure 16:
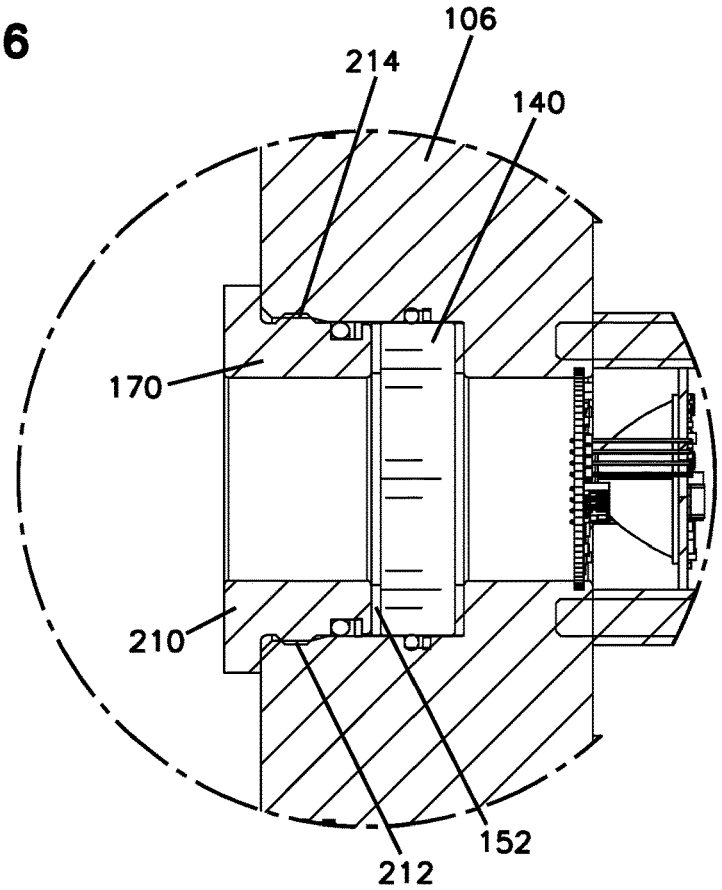
FIG. 16 is a detail view of a portion of a pressure vessel arrangement showing an alternative technique for retaining the optical window.

Now referring to FIG. 16, an alternative arrangement is provided for attaching the optical window 140 to the first end cap 106. The retainer 170 is provided as a threaded retention plug 210 having a threaded exterior surface 212 that engages a corresponding interior threaded surface 214 on the first end cap 106. The inside gasket 152 is held between the window inside surface 156 and the bracket 210.

It should be understood that various changes and modifications to the preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed:

1. A pressure vessel arrangement comprising:

(a) a pressure vessel comprising:

a cylinder construction having a cylinder wall extending from a cylinder wall first end to a cylinder wall second end, and having an internal surface forming an interior region;

a first end cap closing the cylinder wall first end and having an optical window located therein to permit passage of light therethough and into the interior region, wherein the optical window comprises a first surface and a second, opposite, surface, wherein:

(i) the first end cap comprises:

(A) a cap structure having an optical window receiving region;

(B) an optical window attachment construction for holding the optical window in place within the optical window receiving region;

(C) a first seal gasket located between the optical window first surface and a surface of the cap structure to prevent the optical window first surface from contacting the surface of the cap structure; and (D) a second seal gasket located between the optical window second surface and the optical window attachment construction;

a second end cap closing the cylinder wall second end; and a piston constructed to slide within the cylinder construction interior region along a direction between the cylinder all first end and the cylinder wall second end and along the cylinder construction internal surface to separate the interior region into a first end interior region and a second end interior region;

(b) an optical sensor arrangement located outside of the optical window and having an emitter that that emits light through the optical window and into the interior region and a receiver that receives light reflected from the piston.

2. A pressure vessel arrangement according to claim 1, wherein the optical window attachment construction includes a retainer for holding the optical window in place within the first end cap.

3. A pressure vessel arrangement according to claim 2, wherein the retainer comprises a snap ring.

4. A pressure vessel arrangement according to claim 2, wherein the retainer comprises a bracket held to the first end cap by a fastener.

5. A pressure vessel arrangement according to claim 2, wherein the retainer comprises a threaded retention plug.

6. A pressure vessel arrangement according to claim 1, wherein the optical window comprises a peripheral surface, and wherein the pressure vessel further comprises a seal member extending around the optical window peripheral surface.

7. A pressure vessel comprising:

a cylinder construction having a cylinder wall extending from a cylinder wall first end to a cylinder wall second end, and having an internal surface forming an interior region;

a first end cap closing the cylinder wall first end and having an optical window located therein to permit passage of light therethough and into the interior region, wherein the optical window comprises a first surface and a second, opposite, surface, wherein:

(i) the first end cap comprises:

(A) a cap structure having an optical window receiving region; and (B) an optical window attachment construction for holding the optical window in place within the optical window receiving region;

(C) a first seal gasket located between the optical window first surface and a surface of the cap structure to prevent the optical window first surface from contacting the surface of the cap structure; and (D) a second seal gasket located between the optical window second surface and the optical window attachment construction;

a second end cap closing the cylinder wall second end; and a piston constructed to slide within the cylinder construction interior region along a direction between the cylinder all first end and the cylinder wall second end and along the cylinder construction internal surface to separate the interior region into a first end interior region and a second end interior region.

8. A pressure vessel according to claim 7, wherein the optical window attachment construction includes a retainer for holding the optical window in place within the first end cap.

9. A pressure vessel according to claim 8, wherein the retainer comprises a snap ring.

10. A pressure vessel according to claim 8, wherein the retainer comprises a bracket held to the first end cap by a fastener.

11. A pressure vessel according to claim 8, wherein the retainer comprises a threaded retention plug.

12. A pressure vessel arrangement according to claim 7, wherein the optical window comprises a peripheral surface, and wherein the pressure vessel further comprises a seal member extending around the optical window peripheral surface.

13. A method for providing piston position feedback in a pressure vessel comprising:

(a) emitting light through an optical window located in an end cap of the pressure vessel, wherein the optical window comprises a first surface and a second, opposite, surface, the pressure vessel including:

a cylinder construction having a cylinder wall extending from a cylinder wall first end to a cylinder wall second end, and having an internal surface forming an interior region;

a first end cap closing the cylinder wall first end and having the optical window located therein to permit passage of light therethough and into the interior region, wherein:

(i) the first end cap comprises:

(A) a cap structure having an optical window receiving region; and (B) an optical window attachment construction for holding the optical window in place within the optical window receiving region;

(C) a first seal gasket located between the optical window first surface and a surface of the cap structure to prevent the optical window first surface from contacting the surface of the cap structure; and (D) a second seal gasket located between the optical window second surface and the optical window attachment construction;

a second end cap closing the cylinder wall second end; and a piston constructed to slide within the cylinder construction interior region along a direction between the cylinder all first end and the cylinder wall second end and along the cylinder construction internal surface to separate the interior region into a first end interior region and a second end interior region;

(b) receiving light reflected from the piston; and (c) determining the position of the piston in the cylinder construction based on information about the light emitted and the light received.

14. A method according to claim 13, wherein the optical window attachment construction includes a retainer for holding the optical window in place within the first end cap.

15. A method according to claim 14, wherein the retainer comprises a snap ring.

16. A method according to claim 14, wherein the retainer comprises a bracket held to the first end cap by a fastener.

17. A method according to claim 14, wherein the retainer comprises a threaded retention plug.

18. A method according to claim 13, wherein the optical window comprises a peripheral surface, and wherein the pressure vessel further comprises a seal member extending around the optical window peripheral surface.

* * * * *